US012319989B2

(12) United States Patent
Shoemaker et al.

(10) Patent No.: US 12,319,989 B2
(45) Date of Patent: Jun. 3, 2025

(54) HIGH STRENGTH PRESS QUENCHABLE 7XXX ALLOY

(71) Applicant: Kaiser Aluminum Fabricated Products, LLC, Foothill Ranch, CA (US)

(72) Inventors: David J. Shoemaker, Heath, OH (US); Timothy K. Fargo, Southfield, MI (US); Walter Gerberick, Westerville, OH (US); Robert A. Matuska, Heath, OH (US)

(73) Assignee: Kaiser Aluminum Fabricated Products, LLC, Franklin, TN (US)

( * ) Notice: Subject to any disclaimer, the term of this patent is extended or adjusted under 35 U.S.C. 154(b) by 550 days.

(21) Appl. No.: 16/899,301

(22) Filed: Jun. 11, 2020

(65) Prior Publication Data

US 2021/0172044 A1 Jun. 10, 2021

Related U.S. Application Data

(60) Provisional application No. 62/944,200, filed on Dec. 5, 2019.

(51) Int. Cl.

| | |
|---|---|
| ***C22C 21/10*** | (2006.01) |
| ***C21D 8/00*** | (2006.01) |
| ***C21D 9/00*** | (2006.01) |

(52) U.S. Cl.

CPC ..... *C22C 21/10* (2013.01); *C21D 8/00* (2013.01); *C21D 9/0081* (2013.01)

(58) Field of Classification Search

CPC ..... C21D 8/00; C21D 9/0081; C22C 21/10; C22F 1/053

See application file for complete search history.

(56) References Cited

U.S. PATENT DOCUMENTS

| | | | | |
|---|---|---|---|---|
| 2007/0074791 | A1* | 4/2007 | Yoshida | C22C 21/10 148/439 |
| 2011/0297278 | A1* | 12/2011 | Xiong | B22D 27/08 148/502 |
| 2015/0217813 | A1* | 8/2015 | Smeyers | B62D 29/008 148/695 |

(Continued)

FOREIGN PATENT DOCUMENTS

| | | |
|---|---|---|
| CN | 108884525 | 11/2018 |
| EP | 0805219 A1 | 11/1997 |
| WO | 2017075217 A1 | 5/2017 |

*Primary Examiner* — Nicholas A Wang

(74) *Attorney, Agent, or Firm* — Yancy IP Law, PLLC

(57) ABSTRACT

The present invention is directed to a 7xxx series aluminum alloy composition comprising, consisting essentially of, or consisting of (by weight %) of 1.0-1.8% Mg; 7.0-8.3% Zn; 0.10-0.25% Zr; with up to 0.80% Cu and allowable impurities of 0.3% Si, 0.4% Fe, 0.4% Mn, and 0.1% Ti, with other elements restricted as unavoidable impurities limited to 0.05% each and 0.15% total and $MgZn_2$ range of 7.0-9.9% with the balance being aluminum. This 7xxx series aluminum alloy is capable of being produced to achieve its maximum strength by quenching from an elevated hot working operation, such as extrusion, forging or rolling. In one embodiment the alloy is capable of meeting strength levels in excess of 65 KSI/450 MPa yield tensile strength, 69 KSI/480 MPa ultimate tensile strength and 11% elongation.

13 Claims, 4 Drawing Sheets

(56) References Cited

U.S. PATENT DOCUMENTS

| | | | |
|---|---|---|---|
| 2015/0354045 | A1 | 12/2015 | Gable |
| 2016/0237540 | A1 | 8/2016 | Shikama |
| 2017/0121802 | A1 | 5/2017 | Kamat |
| 2019/0062886 | A1 | 2/2019 | Leyvraz |

* cited by examiner

HIGH STRENGTH PRESS QUENCHABLE 7XXX ALLOY

CROSS-REFERENCE TO RELATED APPLICATIONS

This application claims the benefit, under 35 USC 119(e), of U.S. Provisional Application No. 62/944,200 filed Dec. 5, 2019, the contents of which are incorporated herein by reference.

BACKGROUND OF THE INVENTION

1. Field of Invention

The present invention relates to a precipitation hardenable aluminum alloy that is highly quench insensitive and thus capable of achieving superior strengths by quenching from the elevated temperatures of hot working processes such as extrusion, forging and rolling. The alloy is also highly resistant to corrosion, specifically stress corrosion cracking (SCC), and provides stable mechanical properties over long term moderate temperature exposures.

2. Description of Related Art

In an effort to improve fuel efficiency in the automotive industry, a great deal of focus has been given to investigating lighter weight materials. Aluminum alloys provide an alternative to steel and can significantly reduce the weight of the vehicle because of the higher specific strength (strength divided by density). As further weight reduction is needed, the advantage of aluminum alloys can be further increased with even higher strength alloys that have only negligible differences in density from previous aluminum alloys. Historically 6XXX aluminum alloys, with $Mg_2Si$ as the primary strengthening precipitate, have been used. These 6XXX alloys are versatile, easily produced by several production methods (extrusion, forging or rolling) and have material characteristics favorable for automotive applications such as corrosion resistance and stable mechanical properties over long term moderate temperature exposure. Naturally as these alloys were used, higher strength variants have been introduced in an effort to further reduce the vehicle weight and achieve even greater fuel efficiencies. Strengths higher than 400 MPa YTS (yield tensile strength) in 6XXX alloys, however, are difficult to consistently achieve and thus the 6XXX alloys have design limitations that prevent additional weight reduction.

Historically, higher strengths have been achieved in 7XXX aluminum alloys. These alloys have been used extensively in the aerospace industry and strengths of greater than 520 MPa YTS (yield tensile strength) can be achieved in some of these alloys. The 7XXX alloys are more prone to corrosion issues, specifically stress corrosion cracking (SCC). The susceptibility to SCC has been overcome for aerospace applications with relatively complex artificial aging cycles and control methods that monitor strength relative to the material electrical conductivity. These 7XXX alloys are also more quench sensitive, meaning the rate at which they must be cooled from an elevated temperature to assure solid state solution of the precipitating hardening elements is quite high. This makes many fabrication methods impractical, such as extrusion using quenches to achieve maximum mechanical properties. While these historical 7XXX alloys have attractive properties, the added complexity required to achieve them makes them cost prohibitive for most automotive platform applications.

While the primary alloying element in 7XXX alloys is Zn, much of their strength is achieved with the addition of Mg and Cu as well. In conjunction they form S-phase ($Al_2CuMg$) which is the primary phase responsible for the quench sensitivity in 7XXX alloys. Thus, by reducing Cu, the S-phase and thus the impact on quench sensitivity can be minimized. Yet some Cu is required for SCC resistance. Aluminum 7XXX alloys that are Cu free have historically had relatively poor performance from an SCC perspective.

Another aspect of 7XXX alloys relative to automotive applications is their relative resistance to moderate temperature exposure for extended times. The long-term thermal stability as measured by tensile strength has been reported to be inferior in these 7XXX alloys as compared to available 6XXX alloys at the time. As many automotive components are exposed to moderate heat levels, it is necessary that their mechanical properties are stable over long term exposure.

BRIEF SUMMARY OF THE INVENTION

The present invention is directed to a 7XXX alloy that is highly quench insensitive, achieves strengths in excess of 450 MPa YTS (yield tensile strength), and achieves increased stress corrosion cracking (SCC) resistance. A preferred application for this 7XXX alloy is in automotive applications to provide acceptable thermal stability over long periods of exposure to moderate temperatures.

BRIEF DESCRIPTION OF THE DRAWINGS

The features and advantages of the present invention will become apparent from the following detailed description of a preferred embodiment thereof, taken in conjunction with the accompanying drawings, in which.

DETAILED DESCRIPTION OF THE INVENTION

Figure 1:
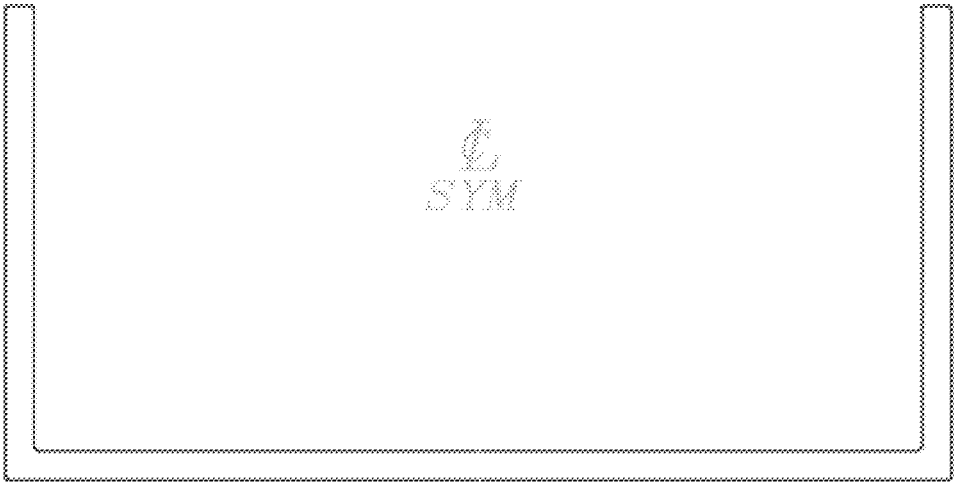
FIG. 1 shows the extruded shape used in Example 2.

The present invention is directed to a 7XXX series aluminum alloy composition comprising, or consisting essentially of, or consisting of (by weight %): 1.0-1.8% Mg; 7.0-8.3% Zn; 0.10-0.25% Zr; 0.02-0.80% Cu, allowable impurities including ≤0.3% Si, ≤0.4% Fe, ≤0.4% Mn, ≤0.1% Ti, and 7.0-9.9% $MgZn_2$, and unavoidable impurities to 0.05% each and 0.15% total unavoidable impurities with the balance being aluminum. The inventive alloy is capable of being produced to achieve its maximum strength by quenching from an elevated hot working operation, such as extrusion, forging or rolling. In one embodiment the alloy is capable of meeting strength levels in excess of 65 KSI/450 MPa yield tensile strength, 69 KSI/480 MPa ultimate tensile strength and 11 elongation. In a preferred embodiment, Cu is restricted to less than 0.25%.

The addition of Zn increases the strength of aluminum alloys, especially when also combined with the addition of Mg. These two elements combine to form precipitates known as $MgZn_2$, which is a very effective strengthening component in precipitation hardening alloys. The proportion at which these elements are added is thus also an important consideration as it will determine the total amount $MgZn_2$, free Zn or free Mg in the alloy. The Mg will preferentially react with Si to form $Mg_2Si$, and thus this reaction must be considered as well. Mg will also react with Cu to form S-phase ($Al_2CuMg$) which also is precipitation hardening component. The addition of Cu and the presence of S-phase, however, increases the quench sensitivity of the alloy. Quench sensitivity is defined as an alloy's sensitivity to the rate at which it is cooled from the solvus temperature to ensure all precipitation hardening phases are kept in solid state solution. Alloys that are considered more quench sensitive require faster cooling rates from solvus temperatures than alloys that are less quench sensitive. While Cu increases quench sensitivity, small Cu additions are necessary to assure adequate resistance to stress corrosion cracking (SCC). Thus small amounts of Cu are added to this alloy for the purposes of corrosion resistance as opposed to increasing the strength potential of the alloy. The addition of Zr is done to restrict recrystallization in the structure. Generally, unrecrystallized microstructures are preferred to recrystallized structures. Zr forms a dispersoid ($Al_3Zr$) which restricts recrystallization and helps to achieve the preferred structure. In some cases, however, a recrystallized structure may be preferred (for example to improve formability, especially in multi-axial forming applications), in which limiting the amount of Zr may be considered preferential.

Alloying elements have many complex interactions and form some phases preferentially over other phases. As the amount of $MgZn_2$, $Al_2CuMg$ and free Zn are primary components for determining the alloy properties and characteristics, it is necessary to define how these contents are calculated. First the available Mg is determined. Since Mg will preferentially form $Mg_2Si$ over $MgZn_2$ and $Al_2CuMg$, the amount of Mg consumed by Si must be determined by first calculating the wt % of $Mg_2Si$, which is wt % Si (1+(2(Atomic Wt Mg)/(Atomic Wt Si)). The resulting Mg free for other phases is then determined by wt % Mg−(wt % $Mg_2Si$−wt % Si).

Cu will preferentially form $Al_7Cu_2Fe$. In order to determine the wt % of $Al_7Cu_2Fe$, first it must be established if there will be excess Cu or excess Fe. This is determined by (2(Atomic Weight Cu)/(atomic Wt Fe)) wt % Fe. If this is greater than the wt % of Cu, there is excess Fe, and conversely if it is less than the wt % of Cu, there is excess Cu. If excess Cu, the amount of $Al_7Cu_2Fe$ is wt % Fe(1+(2(Atomic Wt Cu))/(Atomic Wt Fe)) and if it excess Fe, the amount is Wt % Cu(1+(Atomic Wt Fe)/(2(Atomic Wt Cu))). The remaining available Cu is 0 if excess Fe and if excess Cu is Wt % Cu−(Wt % Fe) (2(Atomic Wt Cu)/(Atomic Wt Fe)).

The S-phase ($Al_2CuMg$) that forms is 0 if there is no remaining Cu. For the compositions studied in the present invention, there was more Mg than required, thus if there is remaining Cu, it is consumed by S-phase and is calculated by the remaining (Wt % Cu) (1+(Atomic Wt Mg)/(Atomic Wt Cu)). The remaining Mg from this reaction is then Remaining Wt % Mg (from the $Mg_2Si$ calculation)−Wt % S-phase formed+Remaining Wt % Cu from the $Al_7Cu_2Fe$ calculation).

The amount of $MgZn_2$ and free Zn or free Mg can then be calculated. First it must be determined if the composition will be excess Zn or excess Mg. If the remaining wt % Mg from the S-phase calculation/wt % Zn is less than (Atomic Wt Mg/(2(Atomic Wt Zn)) then it is excess Zn and the $MgZn_2$ is calculated by remaining (wt % Mg (from S-phase calculation))(1+(2(Atomic Wt Zn)/(Atomic Wt Mg))) and conversely if it is excess Mg it is calculated by (wt % Zn)(1+(Atomic Wt mg)/(2(Atomic Wt Zn))).

If when determining the $MgZn_2$, it was found to be excess Zn, the amount is wt % Zn−wt % $MgZn_2$+wt % Mg (remaining from S-phase calculation). If it was determined to be excess Mg, the excess Mg is determined by wt % Mg (remaining from S-phase calculation)−wt % $MgZn_2$+wt % Zn.

The weight percentages of the respective phases are thus calculated accordingly throughout the present invention.

It is understood that the ranges identified above for the 7XXX series aluminum alloy composition include the upper or lower limits for the element selected and every numerical range provided within the range may be considered an upper or lower limit. For example, it is understood that within the range of 1.0-1.8 wt. % Mg, the upper or lower limit for Mg may be selected from 1.0, 1.1, 1.2, 1.3, 1.4, 1.5, 1.6, 1.7 and 1.8 wt. %. For example, it is understood that within the range of 7.0-8.3 wt. % Zn, the upper or lower limit for Zn may be selected from 7.0, 7.1, 7.2, 7.3, 7.4, 7.5, 7.6, 7.7, 7.8, 7.9, 8.0, 8.1, 8.2, and 8.3 wt. %. For example, it is understood that within the range of 0.10-0.25 wt. % Zr, the upper or lower limit for Zr may be selected from 0.10, 0.12, 0.14, 0.16, 0.18, 0.20, 0.22, 0.24 and 0.25 wt. %. For example, it is understood that within the range of 0.02-0.80 wt. % Cu, the upper or lower limit for Cu may be selected from 0.80, 0.70, 0.60, 0.50, 0.40, 0.30, 0.20, 0.10, 0.05, and 0.02 wt. %. For example, it is understood that within the range of allowable impurities of 0.3 wt. % Si, the upper or lower limit for Si may be selected from 0.3, 0.25, 0.20, 0.15, 0.10, and 0.05 wt. %. For example, it is understood that within the range of allowable impurities of 0.4 wt. % Fe, the upper or lower limit for Fe may be selected from 0.4, 0.35, 0.30, 0.25, 0.20, 0.15, 0.10, and 0.05 wt. %. For example, it is understood that within the range of allowable impurities of 0.4 wt. % Mn, the upper or lower limit for Mn may be selected from 0.4, 0.35, 0.30, 0.25, 0.20, 0.15, 0.10, and 0.05 wt. %. For example, it is understood that within the range of 7.0-9.9 wt. % $MgZn_2$, the upper or lower limit for $MgZn_2$ may be selected from 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0. 9.1, 9.2, 9.3, 9.4, 9.5, 9.6, 9.7, 9.8, 9.9 wt. %. For Example, it is understood that strength levels in excess of 450 MPa yield tensile strength include yield tensile strengths in excess of 460, 470, 480, 490 and 500 MPa, which may further be upper and/or lower limits thereof. For Example, it is understood that strength levels in excess of 480 MPa ultimate tensile strength include ultimate tensile strengths in excess of 490, 500, 510, 520, 530, and 540 MPa, which may further be upper and/or lower limits thereof. It is further understood that any and all permutations of the ranges identified above are included within the scope of the present invention.

In one embodiment, the 7XXX series aluminum alloy composition comprising, or consisting essentially of, or consisting of (by weight %): 1.0-1.8% Mg; 7.0-8.3% Zn; 0.10-0.25% Zr; 0.02-0.25% Cu, allowable impurities including ≤0.3% Si, ≤0.4% Fe, ≤0.4% Mn, ≤0.1% Ti, and 7.9-9.9% $MgZn_2$ with a minimum of 0.25% excess Zn, and unavoidable impurities ≤ to 0.05% each and 0.15% total unavoidable impurities.

In one embodiment of the present invention, extrusion billets including the present 7xxx series aluminum alloy composition are cast using conventional direct chill casting methods. These billets are homogenized at 890° F. (477° C.) for 12 hours. The billets are then pre-heated to 900-980° F. (482-527° C.) and extruded into a desired shape. In one embodiment, the desired shape is a multi-void hollow shape. In an alternative embodiment, the desired shape is a channel. The extruded product is water quenched or quenched with forced air cooling only. In order to test the quench sensitivity of these alloys the samples are resolutionized by heating to 890° F. (477° C.) and quenched in either still air, forced air (fan) or cold water immersion. Samples are then artificially aged using a two-step age practice with the first step at 230-270° F. (110-132° C.) for 1-6 hours and the second at 265-305° F. (129-152° C.) for 10-15 hours.

The 7xxx series aluminum alloy composition of the present invention may be an extruded, forged or rolled product having low quench sensitivity as defined as achieving 95% of maximum mechanical properties via forced air quenching.

The 7xxx series aluminum alloy composition of the present invention may be an extruded, forged or rolled product capable of passing SCC testing per ASTM G-44, said ASTM G-44 expressly incorporated herein by reference, stressed to 90% of the product tensile yield strength and exposed for a 60 day test period, with results of pitting only.

The 7xxx series aluminum alloy composition of the present invention may be an extruded, forged or rolled product capable of withstanding extended periods of heat exposure at elevated temperatures while maintaining strength levels. In one embodiment, the product may be exposed at a temperature of 100° C. for up to 249 hours, or 504 hours, or 750 hours, or 1000 hours, or 1250 hours, or 1498 hours, or 1755 hours, or 2000 hours and still maintain strength levels well above the target minimum yield tensile strength of 450 MPa, or above 470 MPa, or above 480 MPa and the target minimum ultimate tensile strength of 480 MPa, or above 485 MPa, or above 490 MPa, or above 495 MPa.

The following examples illustrate various aspects of the invention and are not intended to limit the scope of the invention.

Example 1

Extrusion billets were cast in 7" (178 mm) diameter using conventional direct chill casting methods. The compositions of these billets are shown in Table 1.

TABLE 1

Composition of Alloys Studied in Example 1

| Alloy | Cu | Fe | Si | Mg | Zn | Zr | $MgZn_2$ | Free Zn |
|---|---|---|---|---|---|---|---|---|
| 946 | 0.19 | 0.17 | 0.09 | 1.03 | 6.23 | 0.12 | 5.61 | 1.50 |
| 950 | 0.34 | 0.20 | 0.09 | 1.31 | 6.93 | 0.13 | 7.28 | 0.69 |

Figure 3:
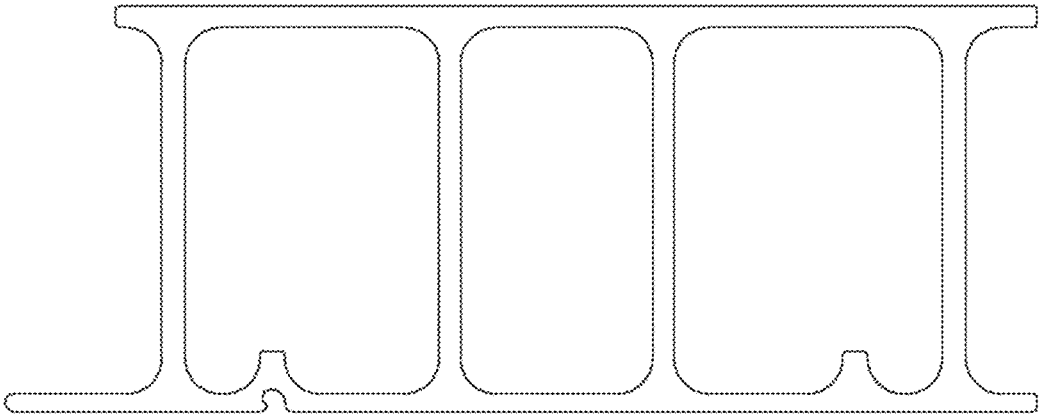
FIG. 3 shows the extruded shape used in Examples 1 and 3.
Figure 4:
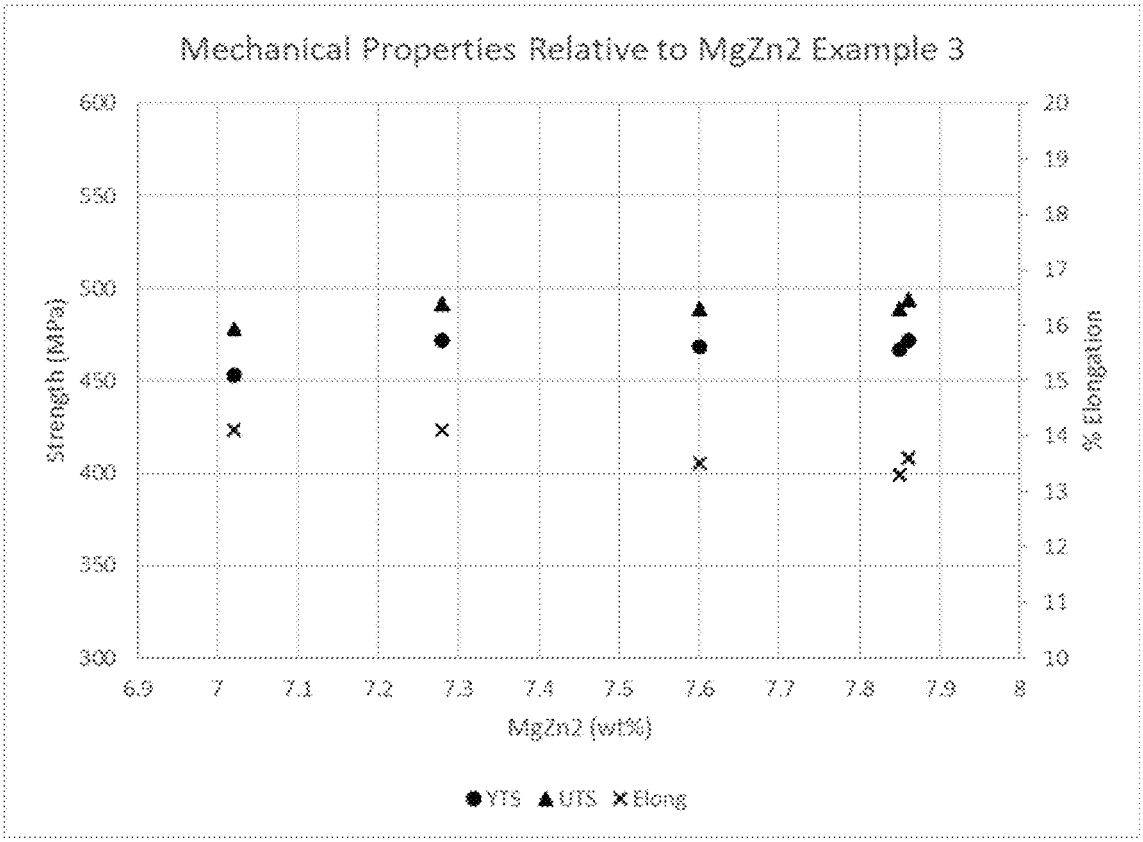
FIG. 4 is a graph showing the mechanical properties from Example 3.

These billets were homogenized at 890° F. (477° C.) for 12 hours. The billets were then pre-heated to 900-980° F. (482-527° C.) and extruded into a multi-void hollow shape as depicted in FIG. 3. The extrusion ratio (reduction ratio) was 16.3:1. The extruded product was water quenched. In order to test the quench sensitivity of these alloys the samples were resolutionized by heating to 890° F. (477° C.) and quenched in either still air, forced air (fan) or cold water immersion. Samples were then artificially aged using a two-step age practice with the first step at 230-270° F. (110-132° C.) for 1-6 hours and the second at 265-305° F. (129-152° C.) for 10-15 hours. The resulting mechanical properties are shown in Table 2.

TABLE 2

Mechanical Properties Achieved from Example 2

| Alloy | Quench Method | Yield Tensile Strength (KSI/MPa) | Ultimate Tensile Strength (KSI/MPa) | Percent Elongation |
|---|---|---|---|---|
| 946 | Still Air | 56.3/388 | 62.4/431 | 14.0 |
| | Fan | 58.9/406 | 64.9/448 | 13.8 |
| | Cold Water | 59.5/411 | 65.1/449 | 13.5 |
| 950 | Still Air | 62.3/430 | 68.3/471 | 12.6 |
| | Fan | 65.3/451 | 70.7/488 | 12.1 |
| | Cold Water | 65.3/451 | 70.6/487 | 14.0 |

While these results fall short of the mechanical property goal of 450 MPa yield tensile strength, these results showed that the quench sensitivity issue can be resolved with low Cu compositions and using a minimum of forced air cooling.

Example 2

Extrusion billets were cast in 9" (229 mm) diameter using conventional direct chill casting methods. The compositions of these billets are shown in Table 3.

TABLE 3

Composition of Alloys Studied in Example 2

| Alloy | Cu | Fe | Si | Mg | Zn | Zr | $MgZn_2$ | Free Zn |
|---|---|---|---|---|---|---|---|---|
| 1465 | 0.20 | 0.20 | 0.10 | 1.29 | 6.57 | 0.15 | 7.12 | 0.56 |
| 1462 | 0.20 | 0.23 | 0.12 | 1.25 | 6.85 | 0.13 | 6.65 | 1.25 |
| 1463 | 0.20 | 0.19 | 0.11 | 1.27 | 7.33 | 0.15 | 6.89 | 1.53 |
| 1464 | 0.20 | 0.23 | 0.11 | 1.43 | 7.39 | 0.15 | 7.91 | 0.72 |
| 1466 | 0.20 | 0.18 | 0.10 | 1.44 | 7.74 | 0.15 | 8.08 | 0.93 |
| 1467 | 0.19 | 0.18 | 0.10 | 1.42 | 8.19 | 0.16 | 7.95 | 1.49 |
| 1468 | 0.20 | 0.19 | 0.10 | 1.57 | 8.34 | 0.17 | 8.91 | 0.83 |
| 1469 | 0.19 | 0.18 | 0.11 | 1.56 | 8.58 | 0.15 | 8.74 | 1.22 |
| 1470 | 0.19 | 0.17 | 0.11 | 1.53 | 8.89 | 0.15 | 8.54 | 1.69 |

These billets were homogenized at 890° F. (477° C.) for 12 hours. The billets were then pre-heated to 900-980° F. (482-527° C.) and extruded into a channel as depicted in FIG. 1. The extrusion ratio (reduction ratio) was 69:1. The extruded product was quenched with forced air cooling only. The resulting microstructure was evaluated and determined to be unrecrystallized. Samples from the extrusion were artificially aged using a two-step practice, the first being at 230-270° F. (110-132° C.) for 1-6 hours and the second step at 265-305° F. (129-152° C.) for 10-15 hours. The resulting mechanical properties are shown in Table 4.

TABLE 4

Mechanical Properties Achieved from Example 2

| Alloy | Yield Tensile Strength (KSI/MPa) | Ultimate Tensile Strength (KSI/MPa) | Percent Elongation |
|---|---|---|---|
| 1465 | 65.7/453 | 72.0/497 | 12.5 |
| 1462 | 67.4/465 | 73.6/508 | 12.6 |
| 1463 | 67.5/466 | 73.9/510 | 12.2 |
| 1464 | 70.1/484 | 75.7/522 | 11.9 |
| 1466 | 70.4/486 | 76.7/529 | 12.3 |

TABLE 4-continued

| Mechanical Properties Achieved from Example 2 | | | |
|---|---|---|---|
| Alloy | Yield Tensile Strength (KSI/MPa) | Ultimate Tensile Strength (KSI/MPa) | Percent Elongation |
| 1467 | 70.4/486 | 76.8/530 | 13.1 |
| 1468 | 74.1/511 | 79.6/549 | 11.8 |
| 1469 | 73.9/510 | 78.4/541 | 11.7 |
| 1470 | 73.0/504 | 78.0/538 | 11.3 |

Figure 2:
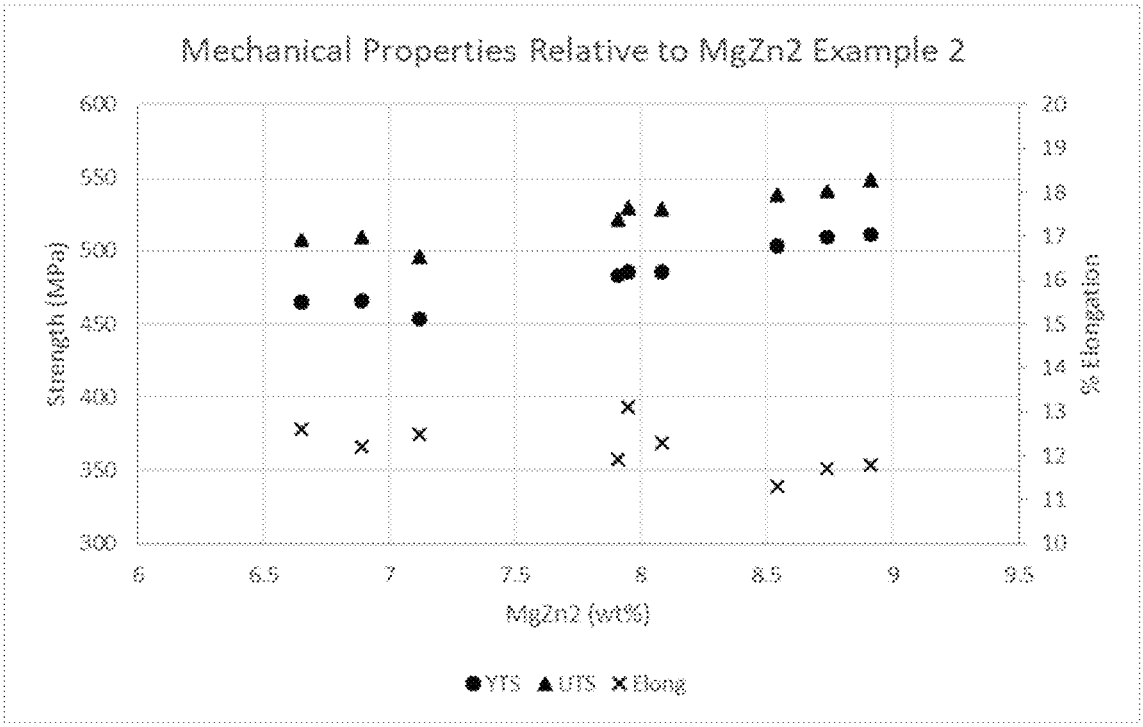
FIG. 2 is a graph showing the mechanical properties from Example 2.

FIG. 2 shows these mechanical property results graphically by the $MgZn_2$ content. The $MgZn_2$ had the more pronounced effect on strength, but some of the variation can also be attributed to the amount of free Zn in the structure. These results clearly show that by increasing the $MgZn_2$ levels, the strength of these alloys can be significantly increased. In order to consistently meet a minimum 450 MPa yield tensile strength, however, the compositions studied in example 1 with the least $MgZn_2$ were marginal. Thus, a second study was conducted with target $MgZn_2$ minimum levels of 7.0 to validate the goal of 450 MPa could be consistently achieved with this composition target.

Example 3

Extrusion billets were cast in 9" (229 mm) diameter using conventional direct chill casting methods. The compositions of these billets is shown in Table 5.

TABLE 5

| Composition of Alloys Studied in Example 3 | | | | | | | | |
|---|---|---|---|---|---|---|---|---|
| Alloy | Cu | Fe | Si | Mg | Zn | Zr | $MgZn_2$ | Free Zn |
| CP1 | 0.20 | 0.20 | 0.10 | 1.27 | 6.99 | 0.13 | 7.02 | 1.07 |
| CP2 | 0.20 | 0.19 | 0.08 | 1.28 | 7.52 | 0.13 | 7.28 | 1.38 |
| MP | 0.19 | 0.21 | 0.08 | 1.33 | 7.27 | 0.13 | 7.60 | 0.86 |
| CP3 | 0.20 | 0.21 | 0.10 | 1.40 | 7.10 | 0.13 | 7.86 | 0.47 |
| CP4 | 0.20 | 0.20 | 0.08 | 1.37 | 7.49 | 0.13 | 7.85 | 0.90 |

The billets were homogenized at 890° F. (477° C.) for 12 hours. The billets were then preheated to 900° F.-980° F. (482° C.-527° C.) and extruded in a multi-void hollow shape as depicted in FIG. 3, with wall thicknesses ranging from 2.50 mm to 3.00 mm. The extrusion ratio was 27:1. The product was quenched from the extrusion temperature out of the press using forced air cooling only. Samples from the extrusion were artificially aged using a two-step practice, the first being at 230-270° F. (110-132° C.) for 1-6 hours and the second step at 265-305° F. (129-152° C.) for 10-15 hours. The resulting grain structure was determined to be predominantly unrecrystallized. The resulting mechanical properties are listed in Table 6.

TABLE 6

| Mechanical Properties Achieved from Example 3 | | | |
|---|---|---|---|
| Alloy | Yield Tensile Strength (KSI/MPa) | Ultimate Tensile Strength (KSI/MPa) | Percent Elongation |
| CP1 | 65.7/453 | 69.3/478 | 14.1 |
| CP2 | 68.4/472 | 71.3/492 | 14.1 |
| MP | 67.8/468 | 70.9/489 | 13.5 |
| CP3 | 68.4/472 | 71.6/494 | 13.6 |
| CP4 | 67.7/467 | 70.9/489 | 13.3 |

These mechanical property results validated that a 450 MPa minimum yield tensile strength could be achieved with a minimum $MgZn_2$ content of 7.0% by weight.

Figure 5:
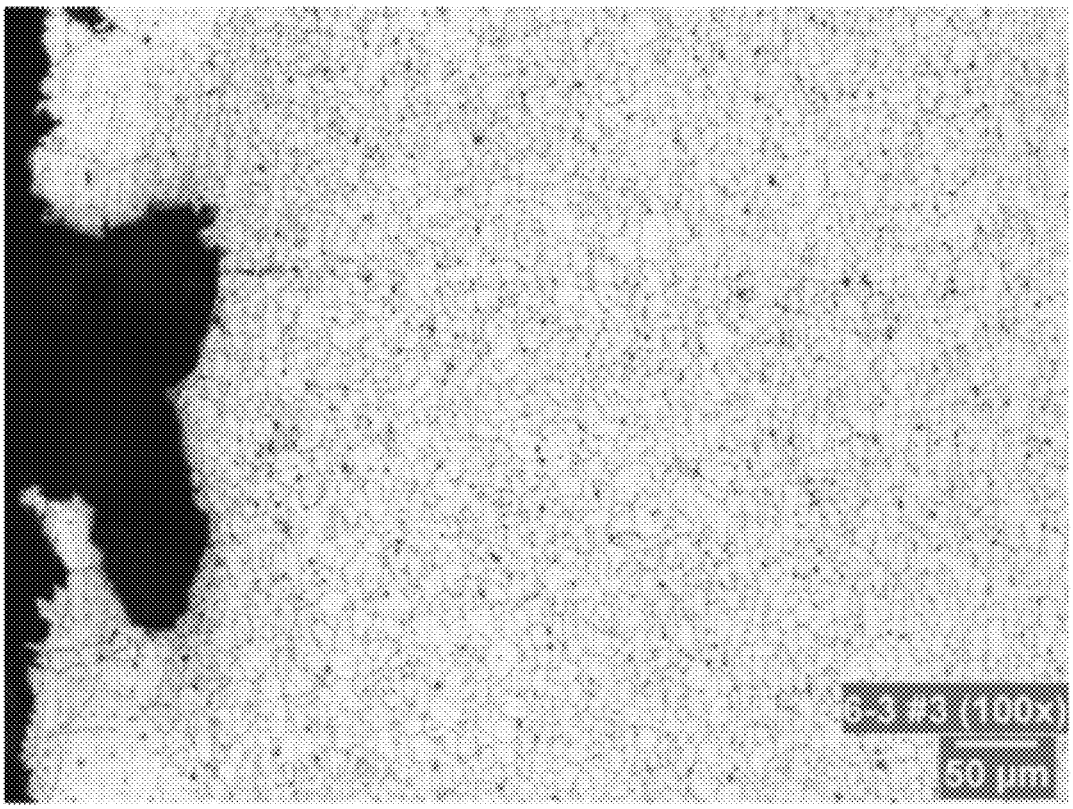
FIG. 5 is metallography of pitted surface post SCC testing per ASTM G-44.

As automotive applications are in corrosive environments, samples from Example 2 were also tested for stress corrosion cracking (SCC) resistance per ASTM G-44, the contents of which are expressly incorporated herein by reference. The stress level for SCC was set at 90% of the received specimen yield tensile strength (70.4 KSI/486 MPa) for resulting test stress level of 63.4 KSI (437 MPa). Samples were exposed for a 60-day test period. Six specimens were prepared and tested. After the 60-days, they were cleaned in nitric acid and examined at low magnification which showed only moderate pitting. A representative sample was selected for metallographic examination to determine pit depth and this also confirmed that no stress corrosion cracking had occurred. A depiction of the metallography is shown in FIG. 5.

Figure 6:
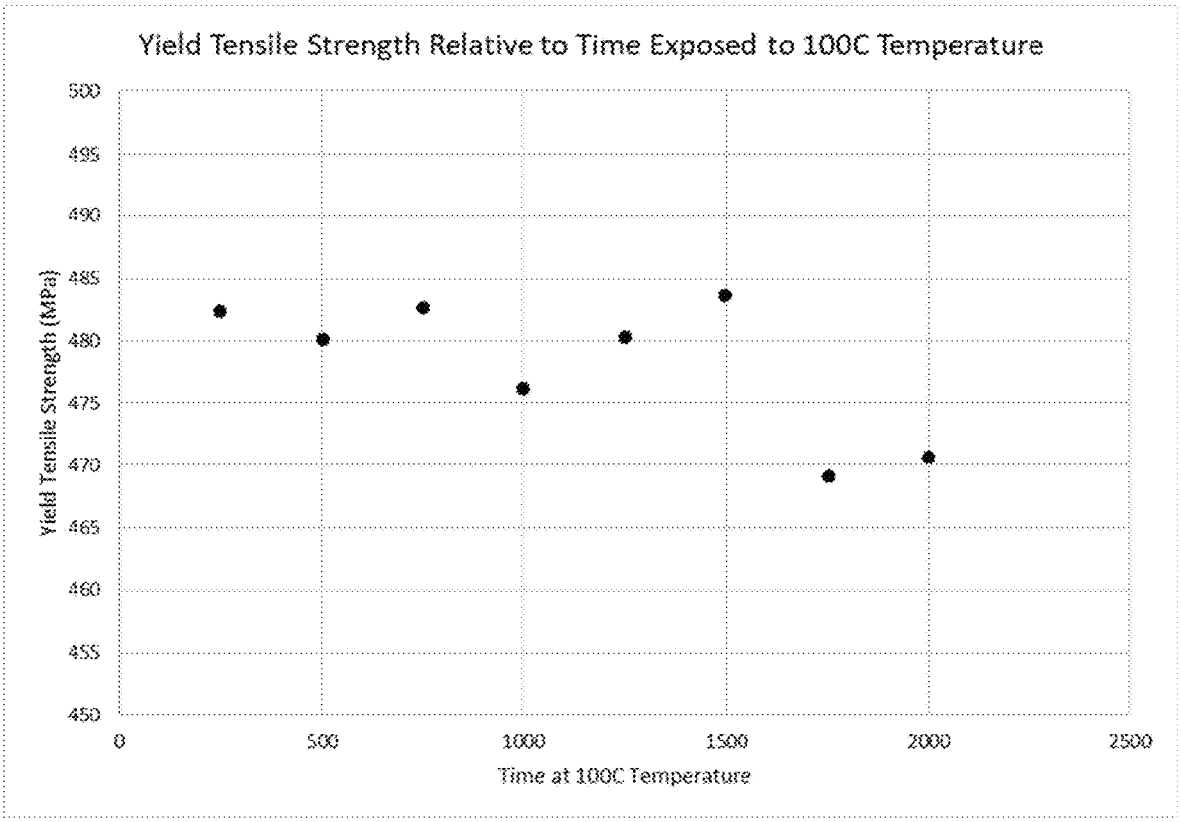
FIG. 6 is a graph showing the yield tensile strength of material from Example 3 over various exposure times to 100° C.

Some automotive applications also have significant temperature exposure. It is thus necessary to assure that the strength is stable over long periods of temperature exposure. To this end, samples of alloy MP from Example 3 were exposed to 100° C. for up to 2000 hours. The results are depicted graphically in FIG. 6 and the results in Table 7.

TABLE 7

| Mechanical Properties After Exposure to Elevated Temperatures (Alloy MP from Example 3) | | | |
|---|---|---|---|
| | Average Mechanical Properties | | |
| Time Exposed to 100° C. (hours) | Yield Tensile Strength (MPa) | Ultimate Tensile Strength (MPa) | % Elongation |
| 249 | 482.4 | 496.4 | 12.8 |
| 504 | 480.1 | 494.5 | 12.3 |
| 750 | 482.6 | 498.4 | 12.3 |
| 1000 | 476.2 | 489.9 | 11.9 |
| 1250 | 480.3 | 498.4 | 12.7 |
| 1498 | 483.6 | 498.4 | 11.8 |
| 1755 | 469.1 | 485.6 | 12.7 |
| 2000 | 470.6 | 486.4 | 12.7 |

The data shows the yield tensile strength has a range of only 14.5 MPa over the samples evaluated from up to 2000 hours exposure to elevated temperatures and still maintained strength levels well above the target minimum yield tensile strength of 450 MPa, or above 470 MPa, and the target minimum ultimate tensile strength of 480 MPa, or above 485 MPa. Note that this 14.5 MPa range is only 3% of the maximum observed strength in this study.

Although the present invention has been disclosed in terms of a preferred embodiment, it will be understood that numerous additional modifications and variations could be made thereto without departing from the scope of the invention as defined by the following claims:

The invention claimed is:

1. An extruded, forged or rolled product manufactured from a 7xxx series aluminum alloy having a composition consisting of, (by weight %):

1.0-1.8% Mg
7.3-8.3% Zn
0.10-0.25% Zr
0.02-0.40% Cu
≤0.3% Si
≤<0.4% Fe
≤<0.4% Mn
≤<0.1% Ti 4.0-9.9% $MgZn_2$ with other elements restricted as unavoidable impurities limited to 0.05% each and 0.15% total; and the balance aluminum, wherein said extruded, forged or rolled product has a low quench sensitivity as defined as achieving 95% of maximum mechanical properties via forced air quenching.

2. The extruded, forged or rolled product manufactured from claim 1 having a yield tensile strength greater than 450 MPa.

3. The extruded, forged or rolled product manufactured from claim 2 passing SCC testing per ASTM G-44 (Reapproved 2013) stressed to 90% of the product tensile yield strength and exposed for a 60 day test period, with results of pitting only.

4. The extruded, forged or rolled product manufactured from claim 3 having an ultimate tensile strength greater than 480 MPa.

5. An extruded, forged or rolled product manufactured from the alloy of claim 1 passing SCC testing per ASTM G-44 (Reapproved 2013) stressed to 90% of the product tensile yield strength and exposed for a 60 day test period, with results of pitting only.

6. The extruded, forged or rolled product manufactured from claim 5 having an ultimate tensile strength greater than 480 MPa.

7. An extruded, forged or rolled product manufactured from the alloy of claim 1 having an ultimate tensile strength greater than 480 MPa.

8. The extruded, forged or rolled product manufactured from the alloy of claim 1 having a yield tensile strength greater than 450 MPa when exposed to a temperature of 100° C. for 2000 hours.

9. The extruded, forged or rolled product manufactured from the alloy of claim 1 having an ultimate tensile strength greater than 480 MPa when exposed to a temperature of 100° C. for 2000 hours.

10. The extruded, forged or rolled product manufactured from claim 9 having a yield tensile strength greater than 450 MPa when exposed to a temperature of 100° C. for 2000 hours.

11. The extruded, forged or rolled product manufactured from the alloy of claim 1 used in automotive applications.

12. The extruded, forged or rolled product of claim 1 wherein said Cu is 0.02-0.25% Cu.

13. The extruded, forged or rolled product of claim 1 wherein said Zn is a minimum of 0.25% excess Zn.

* * * * *